United States Patent [19]

Stich et al.

[11] Patent Number: 4,549,862

[45] Date of Patent: Oct. 29, 1985

[54] HYDRAULIC PUMP FOR LOW-VISCOSITY PUMPING MEDIA

[75] Inventors: Bodo Stich, Wiesbaden; Ernst Hassler, Camberg, both of Fed. Rep. of Germany; Ivan-Jaroslav Cyphelly, Gran Canaria, Spain

[73] Assignee: Glyco-Antriebstechnik GmbH, Wiesbaden, Fed. Rep. of Germany

[21] Appl. No.: 598,372

[22] Filed: Apr. 9, 1984

[30] Foreign Application Priority Data

Apr. 9, 1983 [DE] Fed. Rep. of Germany ..... 3312868

[51] Int. Cl.[4] ..... F04C 2/18; F04C 15/00

[52] U.S. Cl. ..... 418/133; 418/152; 418/178

[58] Field of Search ..... 418/133, 152, 178, 179; 415/214

[56] References Cited

U.S. PATENT DOCUMENTS 3,545,900 12/1970 Viner et al. ..... 418/178
3,704,968 12/1972 Haupt ..... 418/178

FOREIGN PATENT DOCUMENTS 815000 9/1951 Fed. Rep. of Germany .
759960 9/1953 Fed. Rep. of Germany .
764698 10/1954 Fed. Rep. of Germany ..... 418/178
2847710 5/1980 Fed. Rep. of Germany .
536245 5/1941 United Kingdom ..... 415/214
548064 9/1942 United Kingdom ..... 418/152
719311 12/1954 United Kingdom ..... 415/214

OTHER PUBLICATIONS

German-language excerpt from, "Lueger Lexikon der Technik", entitled Fertigungstechnik und Arbeitsmaschinen.

*Primary Examiner*—John J. Vrablik
*Attorney, Agent, or Firm*—Karl F. Ross; Herbert Dubno

[57] ABSTRACT

The pump has a casing, bearing members having portions for radial and axial mounting situated in the casing, at least one displacement element having journals rotatably received in the bearing members, a drive shaft extending from outside into the casing and sealed with respect to the casing by a sealing ring and drivably connected to one of the journals. At least the surfaces of each displacement element, of the journals, of the further elements and of the portion of the shaft inside the sealing ring are plasma-nitrided and the portions for axially mounting the journals are coated with a ceramic material. Also the portion of the shaft inside the sealing ring and the journals may be encased by a ceramic material.

4 Claims, 4 Drawing Figures

HYDRAULIC PUMP FOR LOW-VISCOSITY PUMPING MEDIA

The invention relates to a hydraulic pump comprising a casing, radially and axially effective guide members in the casing, at least one displacement element provided with journals which are rotatably received in the guide members, a drive shaft extending from outside into the casing and sealed with respect to the casing by a sealing ring and drivably connected to one such journal, the pump including further elements for the displacement process and being so arranged that a hydrodynamic lubricating film is formed between surfaces moving relative to and in contact with each other.

BACKGROUND OF THE INVENTION

In hydraulic systems using oil, different kinds of hydraulic displacement pumps are known. These include, for example, the vane pump and the gear pump. By the above-mentioned displacement element is to be understood the gears in the case of gear pumps, and the combination of the rotor and vanes in the case of the vane pump. In the case of the vane pump a further component in the form of a pivoting ring is required for the displacement process, although the casing of eccentric configuration may assume the function of the pivoting ring.

Until now the known hydraulic pumps used mainly mineral oils of 20 to 60 cSt (2 to $6\times10^{-5}$ $m^2/s$) at 50° C. Provided an adequate viscosity of the hydraulic liquid is available, no problems are encountered in connection with the known hydraulic pumps; this is also true as regards lubrication.

However, in the case of welding machines, furnace closing machines, machines for treating inflammable materials, etc. attempts have also already been made at using non-inflammable hydraulic liquids, because in these machines a defect in the hydraulic system could immediately cause fire throughout the entire plant. Such non-inflammable hydraulic liquids differ significantly from the customary mineral hydraulic oils. For example, the lubricating properties are particularly critical in the case of oil-in-water emulsions, which are of very low viscosity on account of their low oil content of 2 to 5% and which are more similar to water from the point of view of lubricating effect as well as that of compressibility and protection against corrosion. Water-based operating media (95% water) have already been found for mining applications, and the design of presses, etc. and plants have been made to enable such media to be used. In the case of low-viscosity pumped media, however, special designs have had to be developed for the various system components, such as for example pumps and valves, which have the disadvantages of high cost and a short life.

There continues to be a demand for hydraulic systems for pumped media in the form of emulsions, because these may have the advantage that one and the same medium can be used for lubrication and cooling. In the case of machine tools, for example, it is presently known to use drilling oil or other emulsions for cooling, but mineral oil of higher viscosity for lubrication. Here there is the danger of mixing and hence pollution of one medium for the other.

Apart from the demand for a hydraulic liquid which is difficult to ignite and which is suitable both for lubrication and cooling, so that only a single liquid is used, it is also desirable to conform to the further condition of good heat dissipation or thermal conductivity. As is known, the thermal conductivity of mineral oils is lower than that of emulsions.

Hence, while the desire for using lowviscosity pumping media in place of mineral oils exists, nevertheless there have not until now been provided hydraulic pumps which can be manufactured and operated economically and which have a long life. In the use of gear- and also vane pumps it is found when processing and/or conveying low-viscosity hydraulic fluids, that the thickness of the lubricating film becomes so small that the parts which move relative to each other come into a mixed friction region and are thus subjected to considerable wear.

This problem is particularly prevalent in the case of the gear pump, the so-called "goggle pump", in which the gears are disposed in bearing plates ("goggles"). The latter is subjected to the pumping pressure and acts on the end face side of the gears, so that a pressure-dependent sealing action is produced. When using low-viscosity pumping media the sealing gap must be reduced for the avoidance of leakages and for the achievement of a high efficiency which, however, increases the danger of bringing the moving parts into the mixed friction region. Hence the provision of an economical hydraulic pump for emulsions has until now not yet been achieved.

OBJECT OF THE INVENTION

It is therefore the object of the invention to provide a hydraulic pump of the above-mentioned kind, which is also suitable for low-viscosity pumping media and has a satisfactory efficiency and a long life, in the medium and higher pressure ranges. By "medium pressure ranges" is to be understood 40 to 80 bar (4 to 8 MPa). For mineral oils at higher pressure ranges are presently needed piston pumps, and pressures of 200 or up to 300 bar (20 to 30 MPa) are achieved.

SUMMARY OF THE INVENTION

In order to provide a hydraulic pump which works satisfactorily in the above-mentioned sense in the medium pressure range, the invention provides that at least the surfaces of each displacement element, of said journals, of said further elements and the portion of said shaft inside said sealing ring are plasma-nitrided and the axially guiding means are coated with a ceramic material. The production of such a hydraulic pump is economically justifiable, the latter working in the pressure range demanded and having a long life and a good efficiency, which may here be assumed to be in the region of 70%. The new hydraulic pump enables low-viscosity pumping media, preferably water-based emulsions, which have good thermal conductivity and whose lubricating properties are adequate as a result of the matching of the materials in the places which are prone to wear, to be conveyed. The surfaces of the parts of the pump which move relative to each other are plasma-nitrided and/or provided with a layer of ceramic material. For producing an inexpensive external gear pump it is sufficient to harden the gears, including the journals and the surface running in the sealing ring by plasma-nitriding. The axial guide parts, i.e. in the case of external gear pumps the "goggles", in the case of internal gear pumps the housing elements and in the case of vane pumps the housing, should preferably be provided with a layer of ceramic material.

It is true to say that it is already known to harden gears or generally to harden the surface of a workpiece. For the purpose of obtaining a nitrogen-enriched surface by nitriding the worpieces, there is already known the glow-nitriding (ion nitriding) process, in which ammonia is broken down by means of a glow-discharge, and its nitrogen is applied to the steel surface.

It has however been found, that tooth flanks of the gears in gear pumps which have been hardened in this manner only had a life of only 200 hours, where the hydraulic pump was operated with a water-based operating medium. If, however, in accordance with the invention, the surface of the displacement element and that of the further components required for the displacement process are plasma-nitrided, then the degree of hardening is doubled as compared, for example, with the hitherto known hardening of tooth flanks. Surprisingly plasma-nitrided surfaces in the case of the hydraulic pumps described have resulted in a life of 3000 hours without any noticeable wear.

Since gaps or clearance between the parts which move against each other are responsible for the volumetric and mechanical efficiency, a significantly improved efficiency, or lower losses, can also be achieved in the use of low-viscosity pumping media, thanks to the material selection in accordance with the invention.

In the case of the external gears, the axial guide members are the "goggles". These can be made of aluminum, bronze, grey cast iron, cast iron etc, i.e. materials having emergency running properties for a limited period. Nevertheless this is a case of using soft materials, which wear during normal operation. So far as the "goggles" in the case of external gear pumps, or the axial guide members generally in the case of hydraulic pumps, are concerned, the problem is solved by providing a layer of ceramic material. Preferably aluminium oxide and titanium dioxide can be applied as the ceramic layer to the metal, preferably steel.

The radial guide members themselves need not then be provided with any special surface treatment, if the journals of the displacement element, in the case of the external gear pump the journals of the gear, are plasma-nitrided. The surface running in the sealing ring towards the drive shaft is also preferably treated in this manner, i.e. hardened by plasma-nitriding.

It is however particularly desirable also to encase in a ceramic material the surface of the drive shaft which runs in the sealing ring. Without special hardening of the region in contact with the shaft sealing ring, it has been found that the plastics material of the ring cuts flutes into the shaft, and that even a hardened shaft is damaged over long operating periods, where, for example, a PTFE-coated ring is used for the shaft sealing ring. Consequently an encasement with ceramic material is provided in the region of the lip seal and/or on the surface running in the shaft sealing ring. Thereby damage is eliminated even over long operating periods.

It may also be very advantageous to encase the journals with ceramic material. This measure also serves the purpose of wear resistance and prolongs the life of the hydraulic pump embodying the invention.

By way of a further and advantageous embodiment of the invention, at least one bearing bush of a laminated material, preferably one comprising steel and plastics, is provided in the radial guide members. Thus in the case of the external gear pump the bearing bush is provided in the "goggles" as a kind of lining, whereby the ability to embed for example solid particles which have been displaced and which constitute abrasive parts, is enhanced.

The thickness of the nitride layer is preferably within the range of between 0.01 mm to 0.3 mm. The especially wear resistant layer of ceramic material preferably has a thickness of 0.1 mm to 0.3 mm.

BRIEF DESCRIPTION OF THE DRAWING

Further advantages, features and possible applications of the present invention will become apparent from the following description of a preferred embodiment with reference to the drawing in which.

SPECIFIC DESCRIPTION

Figure 2:
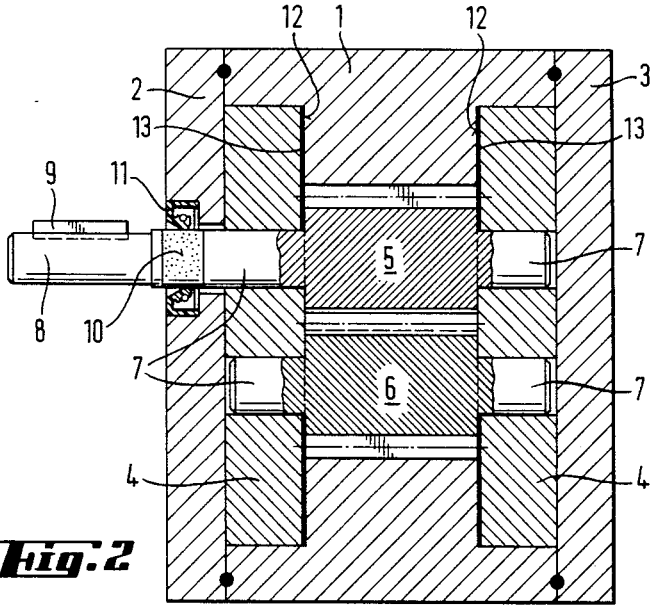
FIG. 2 is another sectional view of the same pump along the section line II—II in FIG. 1.
Figure 3:
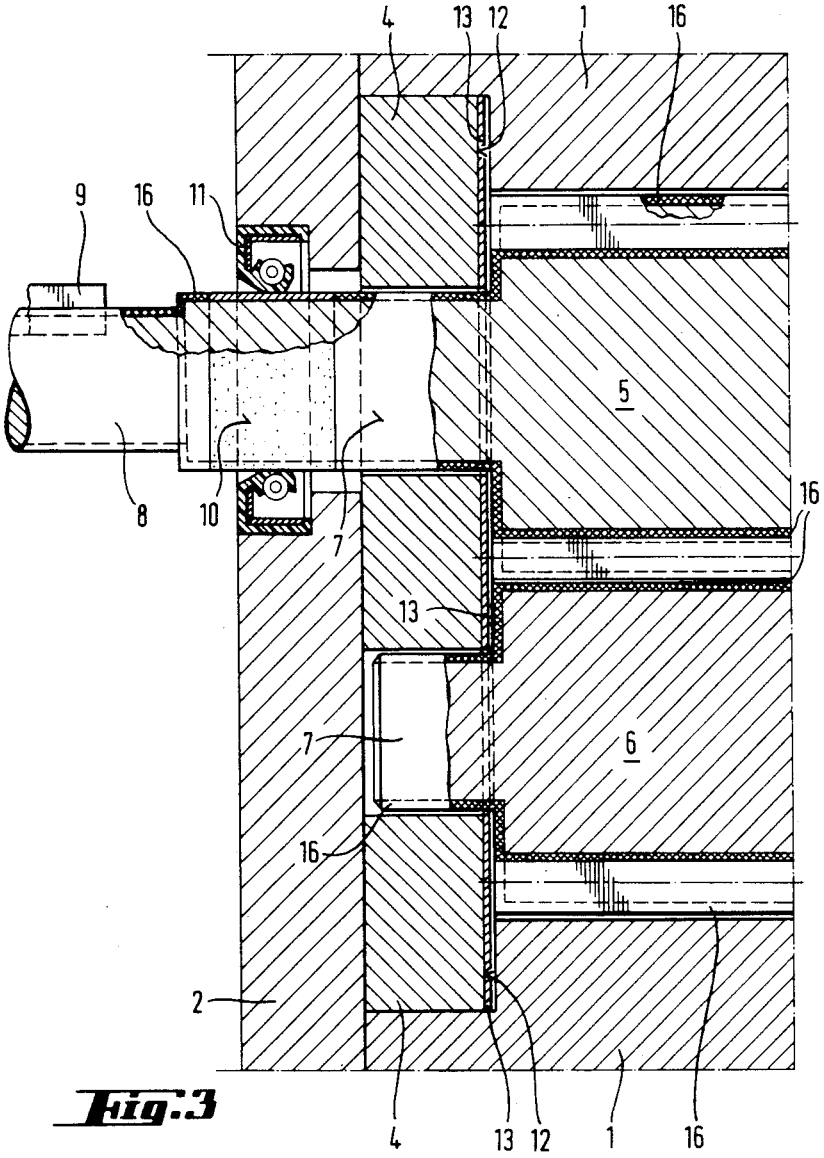
FIG. 3 is a fragmentary view of the lefthand part of FIG. 1 to a larger scale.

The hydraulic pump shown in the drawings has a casing 1 with a sealing cover 2 and a closure cover 3. Below the covers 2 and 3, bearing plates ("goggles") 4 defining radial and axial guide members are disposed. In these two gears, viz. a driving gear 5 and a driven gear 6, defining rotating displacement elements, supported by journals 7, are disposed. One of the journals 7 of the driving gear 5 is extended to the exit from the sealing cover 2 and merges into a drive shaft 8 whose key 9 defining a driving element, is shown in FIGS. 2 and 3. The extended journal 7 of the driving gear 5, which passes through the sealing cover 2, has in the region of the cover 2 a surface 10, which is more clearly shown in FIG. 3 and which is disposed in the region of the shaft sealing ring 11. This shaft or notch sealing ring represents a ring which has been provided with a layer of PTFE or similar polymer.

Figure 1:
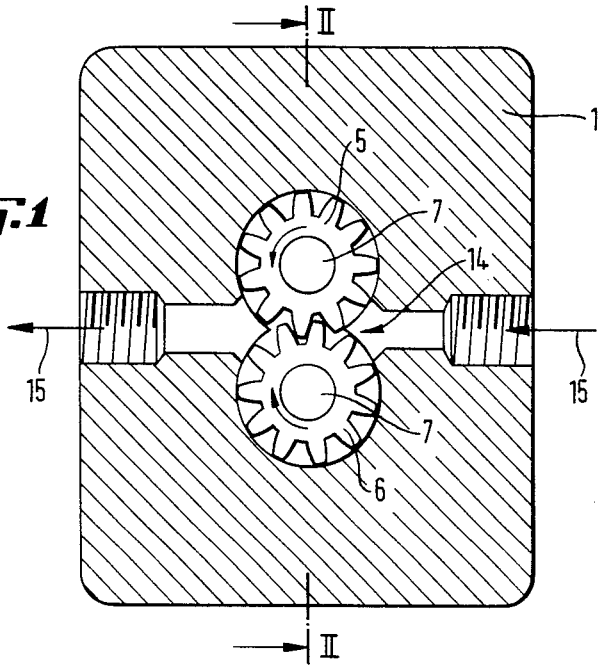
FIG. 1 shows an external gear pump in section.

FIG. 1 shows clearly that in the case of the external gear pump the two parts which move with respect to each other are the gears 5,6 which act as displacement elements and which in operation are especially exposed to wear. In order to keep the latter within economically acceptable limits even when the hydraulic pump is used for low-viscosity pumping media, the surface of the driving gear 5 with the journal 7 and as far as the drive shaft 8, as well as that of the driven gear 6 is plasma-nitrided. In FIG. 3 this nitride layer 16 is shown diagrammatically by cross-hatching. It will readily be appreciated that the entire surface of the displacement elements 5 and 6 is plasma-nitrided, as is also shown diagrammatically in FIG. 3.

In order to make the lateral thrust faces 12 of the bearing plates 4 of the radial and axial guide members particularly wear-resistant, they have applied thereto a layer 13 of ceramic material, which is shown in FIG. 3 by the ordinary hatching (as opposed to the cross-hatching).

In this embodiment the running surface 10 is also encased with ceramic material in the region of the sealing ring 11 for the shaft, which is why the surface 10 running in the sealing ring 11 is also specially sectioned in FIG. 3.

It has been found in the case of the embodiment shown in FIG. 3 that 3000 operating hours are possible without bearing bushes without any noticeable abrasion. This was particularly surprising if one considers in FIG. 1 the region of power transmission proper, which is generally indicated at 14, having regard to the fact that in the case of low-viscosity pumping media, the thickness of the lubricating film is very small here as well as in other regions of relative movement. Thanks to the high degree of hardening resulting from the plasmanitriding the wear could generally be kept down to surprisingly low values.

The arrows 15 in FIG. 1 show the direction of pumping of the low-viscosity medium when the gears 5 and 6 rotate in the direction indicated by the curved arrows.

Figure 4:
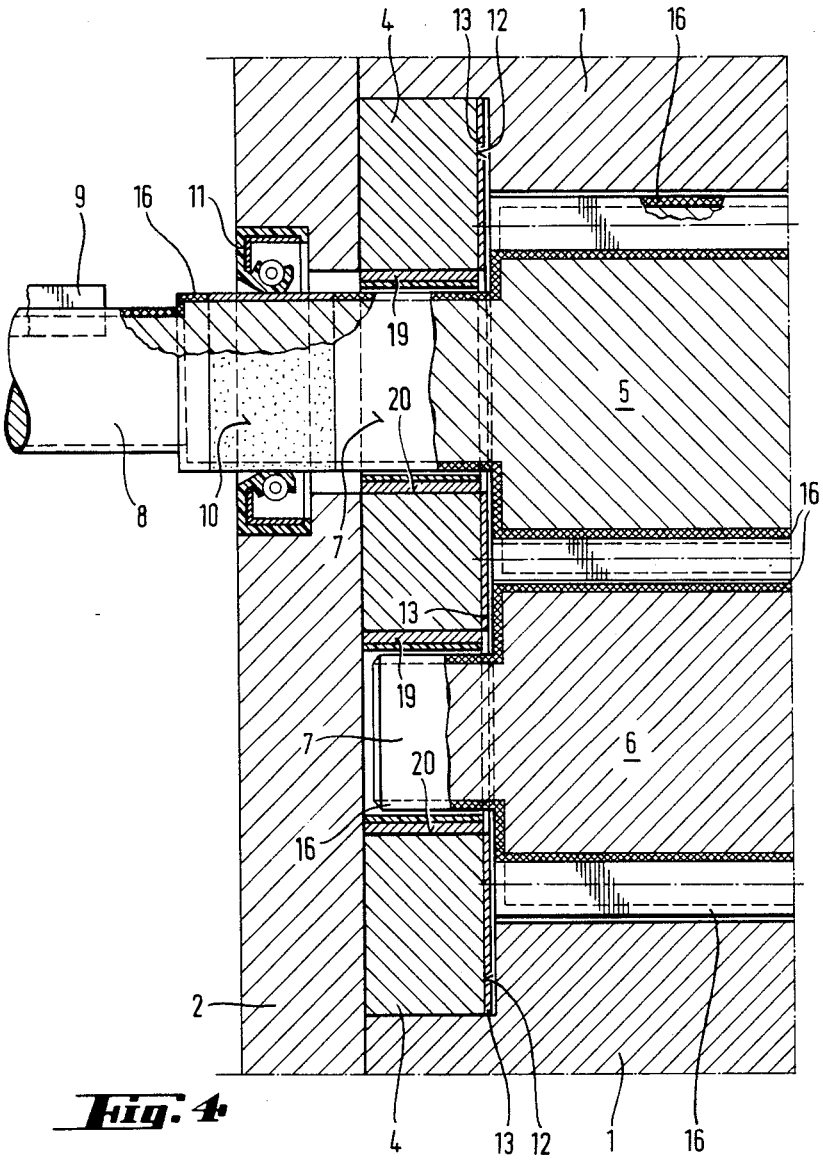
FIG. 4 is the fragmentary view according to FIG. 3 with a bearing bush.

Shown in FIG. 4 is a further, embodiment in which bearing bushes 19 of laminated material are inserted in the apertures 20 of the bearing plates 4, the laminated material comprising steel and plastics.

We claim:

1. A hydraulic pump comprising a casing, guide members providing radially and axially effective guide means situated in the casing, at least one displacement element provided with journals which are rotatably received in said guide members, a drive shaft extending from outside into the casing, sealed with respect to the casing by a sealing ring and drivably connected to one said journal, the pump including further elements for the displacement process and being so arranged that a hydrodynamic lubricating film is formed between surfaces moving relative to, and in contact with, each other, wherein at least the surfaces of each displcement element, of said journals, of said further elements and of the portion of said shaft inside said sealing ring are plasma-nitrided and the axially effective guide means are coated with a ceramic material.

2. A pump according to claim 1 wherein said portion of said shaft inside said sealing ring is encased by a ceramic material.

3. A pump according to claim 1 wherein at least one bearing bush of a laminated material is provided in the radially effective guide means.

4. A pump accorrding to claim 3 wherein said laminated material comprises steel and plastics.

* * * * *